US005672002A

United States Patent [19]

Todd, Jr.

[11] Patent Number: 5,672,002

[45] Date of Patent: Sep. 30, 1997

[54] LIGHT ASSEMBLY FOR A CEILING FAN

[76] Inventor: Alvin E. Todd, Jr., 3360 Progress Hill Blvd., Pigeon Forge, Sevier County, Tenn. 37863

[21] Appl. No.: 642,302

[22] Filed: May 3, 1996

Related U.S. Application Data

[63] Continuation-in-part of Ser. No. 574,127, Dec. 18, 1995, which is a continuation-in-part of Ser. No. 301,658, Sep. 7, 1994, Pat. No. 5,528,469.

[51] Int. Cl.[6] ..... F21V 33/00

[52] U.S. Cl. ..... 362/294; 362/96; 362/404

[58] Field of Search ..... 362/253, 96, 147, 362/285, 294, 373, 404, 405, 421, 427, 287; 403/222; 416/5

[56] References Cited

U.S. PATENT DOCUMENTS

| | | | |
|---|---|---|---|
| 2,784,988 | 3/1957 | Banchback | 403/222 |
| 4,064,427 | 12/1977 | Hansen et al. | 362/96 |
| 4,685,038 | 8/1987 | Huang | 362/294 |
| 4,796,166 | 1/1989 | Greenberg | 362/96 |
| 5,028,206 | 7/1991 | Kendregan et al. | 416/5 |
| 5,072,341 | 12/1991 | Huang | 362/405 |
| 5,082,422 | 1/1992 | Wang | 416/5 |

*Primary Examiner*—Y. My Quach
*Attorney, Agent, or Firm*—Pitts & Brittian, P.C.

[57] ABSTRACT

A light assembly for securing to a ceiling fan. The light assembly includes a plurality of support arms, each defining a first end and a second end, and a securing device to which the first ends are secured. The securing device is securable to a ceiling fan. Each of the second ends carries an illuminating unit such as an incandescent, fluorescent or halogen bulb. The support arms are telescopic such that the distance the second end extends from the securing device is adjustable. Moreover, the second end is pivotable such that the direction in which the illuminating unit points is controllable.

8 Claims, 3 Drawing Sheets

LIGHT ASSEMBLY FOR A CEILING FAN

This application in part discloses and claims subject matter disclosed in my earlier filed pending application, Ser. No. 08/574,127 filed on Dec. 18, 1995, which is a continuation-in-part of my earlier filed pending application, Ser. No. 08/301,658, filed Sep. 7, 1994 now U.S. Pat. No. 5,528,469.

TECHNICAL FIELD

This invention relates to the field of ceiling fans and more specifically to light assemblies mounted on a ceiling fan.

BACKGROUND ART

Ceiling fans are widely used in homes to decorate the home as well as provide ventilation. Typically, ceiling fans are installed by removing an existing light fixture and replacing it with a ceiling fan resulting in a decrease in light available for illuminating a room. Often, ceiling fans are provided with lights which utilize incandescent light bulbs. The light that an incandescent bulb provides may be insufficient and not able to sufficiently illuminate a larger room. Therefore, it desirable to provide a light assembly which can be secured to ceiling fan for providing sufficient light which is able to illuminate a larger room.

Typical of the art are those devices disclosed in the patents listed below.

| U.S. Pat. No. | Inventor | Date |
|---|---|---|
| 4,064,427 | Hansen et al. | Dec. 20, 1977 |
| 4,796,166 | Greenberg | Jan. 3, 1989 |
| 5,028,206 | Kendregan et al. | Jul. 2, 1991 |
| 5,072,341 | Huang | Dec. 10, 1991 |
| 5,082,422 | Wang | Jan. 21, 1992 |

U.S. Pat. No. 4,064,427 discloses a safety guard and light fixture attachment for a ceiling fan wherein individual lamp lights are secured to the outer surface of a guard. The guard surrounds the fan blades and is suspended from the ceiling plate and ceiling. The safety guard and light fixture attachment is complex and not easily secured to the existing ceiling fan.

U.S. Pat. No. 4,796,166 discloses a halogen spotlight assembly for a ceiling fan wherein the spotlight assembly is mounted on the ceiling fan and extends below the fan blades. The spotlight assembly is configured such that the lights are close to the body of the ceiling fan thereby limiting the amount of light provided to the room.

U.S. Pat. No. 5,028,206 discloses an illuminated ceiling fan wherein the neon tubes are secured to the outer periphery of each of the rotating blades. The neon tubes provide a limited amount of light due to their small size. Further, the neon tubes are fixed to the fan blades such that the tubes rotate with the fan blades which results in an erratic light pattern.

U.S. Pat. No. 5,072,341 discloses a lamp assembly in which individual light units are secured to each fan blade. The light units rotate which results in an erratic light pattern.

U.S. Pat. No. 5,082,422 discloses an illuminative fan wherein a plurality of light emitting diodes are disposed on each fan blade which are capable being flashed or colored to produce a variety of effects. The intention is to provide an erratic light pattern for decoration and not to sufficiently illuminate a room.

Therefore, it is an object of this invention to provide a light assembly for securing to a ceiling fan which provides sufficient light to room.

Further, it is an object of the present invention to provide a light assembly which provides a consistent light pattern.

It is another object of the present invention to provide a light assembly which includes a plurality of support arms which are adjustable in length such that the distance an illuminating unit extends from the ceiling fan is adjustable.

It is yet another object of the present invention to provide a light assembly for securing to a ceiling fan wherein the end of each support arm is pivotable.

SUMMARY

Other objects and advantages will be accomplished by the present invention which provides a light assembly which can be secured to a portion of a ceiling fan for sufficiently illuminating a room. The light assembly of the present invention includes a plurality of support arms, the first ends of which are secured to a portion of a ceiling fan via a securing device. Each of the second ends of the support arms carries an illuminating unit. The support arms are telescopic such that the distance the second end extends from the securing device is adjustable. Moreover, each of the second ends is pivotable such that the direction in which the illuminating unit points is controllable.

BRIEF DESCRIPTION OF THE DRAWINGS

The above mentioned features of the invention will become more clearly understood from the following detailed description of the invention read together with the drawings in which.

DESCRIPTION OF PREFERRED EMBODIMENTS

A light assembly for securing to an existing ceiling fan incorporating various features of the present invention is illustrated generally at 10 in the figures. The light assembly 10 is designed to provide more extensive illumination than a traditional ceiling fan which is equipped with a light assembly. Moreover, in the preferred embodiment, the light assembly 10 provides a fixture for supporting a halogen bulb.

Figure 1:
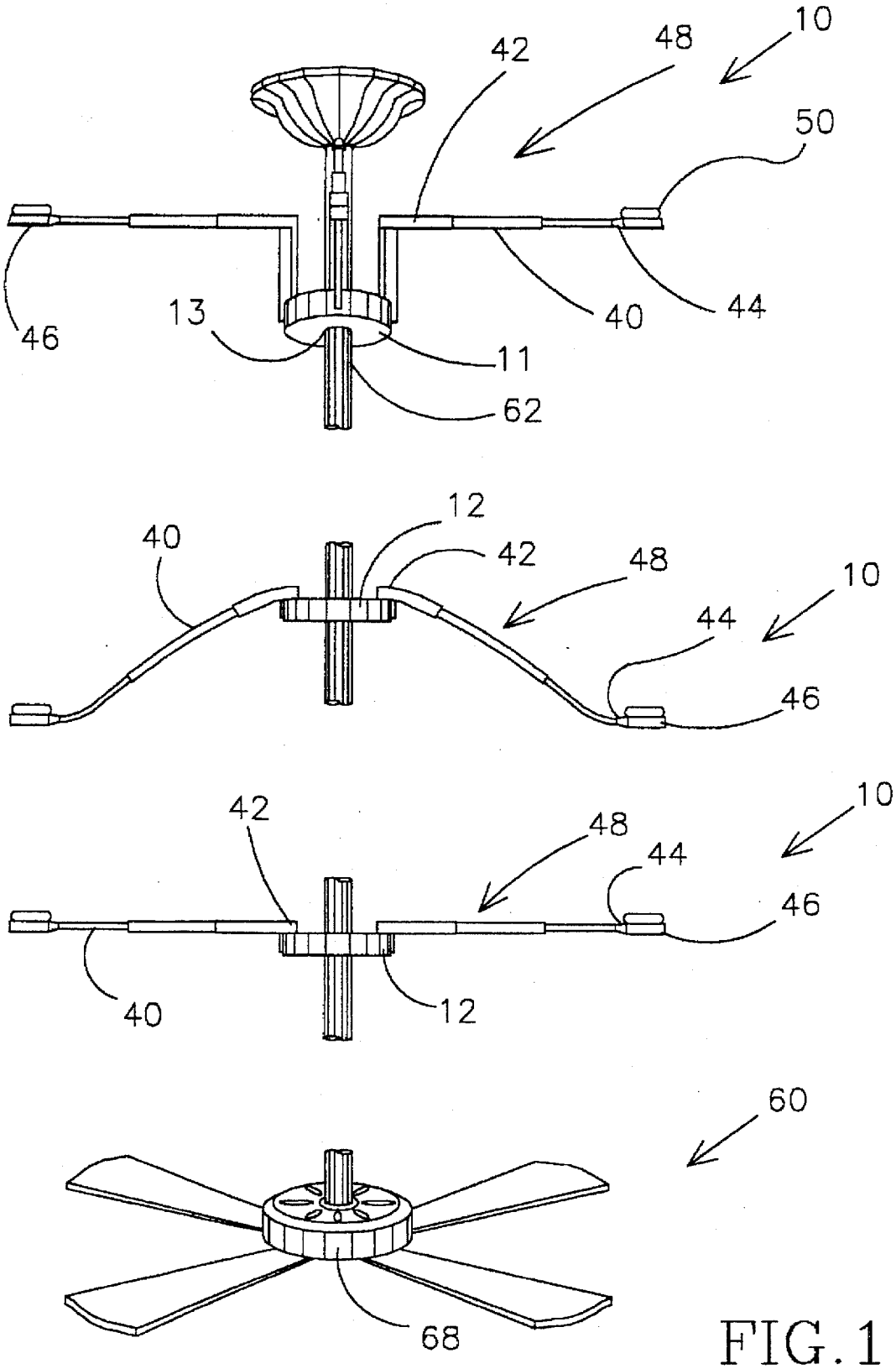
FIG. 1 is a perspective view of the light assembly for securing to a ceiling fan constructed in accordance with several features of the present invention.

The light assembly 10 of the present invention is configured to secure to an existing ceiling fan 60. A conventional ceiling fan 60 is suspended from a ceiling, as shown in FIG. 1. The electrical box which powers the ceiling fan 60 is mounted in the ceiling. The ceiling fan motor 68 which rotates the blades 66 is in electrical communication with the electrical box in the ceiling.

The light assembly 10 is generally comprised of a securing device 11 for securing to a ceiling fan. A plurality of support arms 40 extend from the securing device 11 and the second end 46 of each of the support arms 40 supports an illuminating unit 50.

Figure 6:
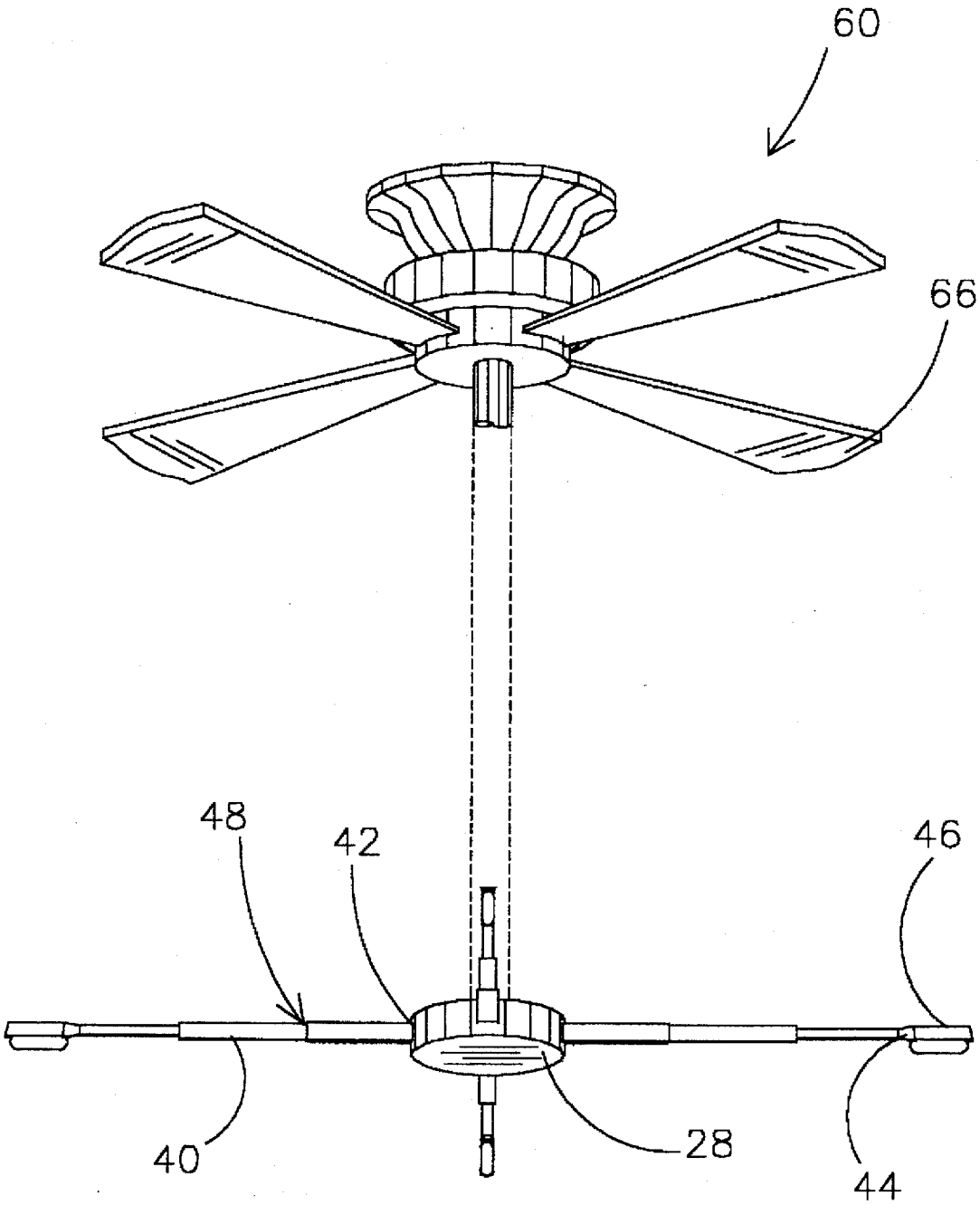
FIG. 6 is a perspective view of the light assembly wherein the securing device is a universal mounting.

The securing device 11 can be one of several embodiments. For example, the securing device 11 can be a collar 12 which generally defines a fastening means for fastening the collar 12 around the shaft 62 of a ceiling fan 60, and a plurality of slots 36 which are configured to receive the first end 42 of each of the support arms 40, as shown in FIG. 1. Further, the securing device 11 can be a universal mounting 28 for mounting to a receptacle below the blades of a ceiling fan, as shown in FIG. 6. Moreover, the support arms 40 can be secured, via a plurality of screws, directly to a portion of the ceiling fan. It will be noted that other means for securing the arms to a ceiling fan with or without an available shaft can be utilized.

Figure 3:
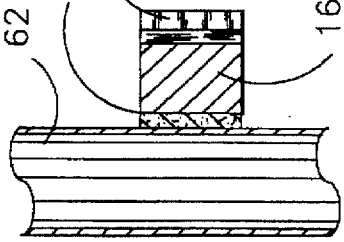
FIG. 3 is a cross sectional view of the collar taken along line 3—3 of FIG. 2.
Figure 5:
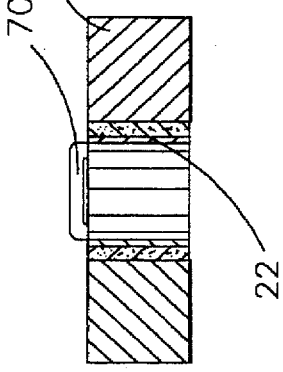
FIG. 5 illustrates a cross sectional view of the collar taken along line 5—5 of FIG. 4.
Figure 2:
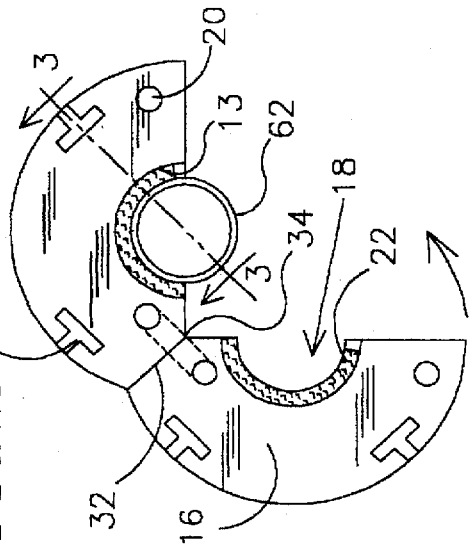
FIG. 2 illustrates a top view of the collar.
Figure 4:
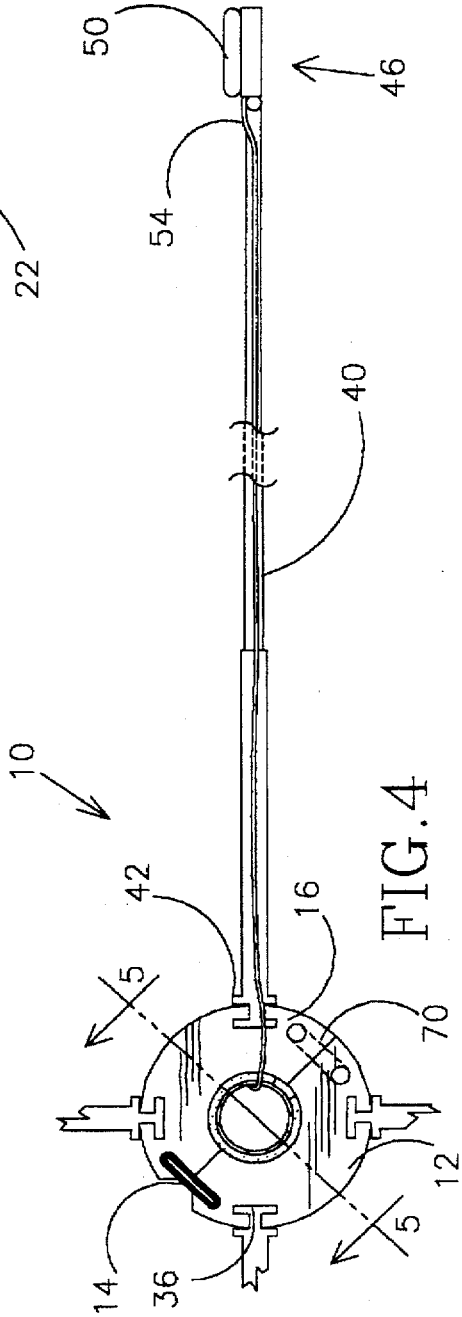
FIG. 4 illustrates top view of the collar and support arms.

In the embodiment shown in FIG. 1, the securing device 11 is a collar 12 which generally defines a fastening means 14 for fastening the collar 12 around the shaft 62 of a ceiling fan 60, and a plurality of slots 36 which are configured to receive the first end 42 of each of the support arms 40. In the embodiment shown in FIG. 1, the collar 12 is secured to the shaft 62 via a compression-type bushing 22 carried at the inner surface 13 of the collar 12. In the preferred embodiment, the collar 12 is comprised of two substantially arcuate plates 16, as shown in FIG. 2. Each plate 16 defines an inner recess 18 which carries the bushing material 22. Further, in this embodiment, the plates 16 of the collar 12 are secured around the shaft 62 by inserting a U-shaped bolt 70 though openings 20 defined by each of the plates 16. The openings 20 align and are able to receive the U-bolts 70, upon alignment of the two plates 16. In the preferred embodiment, each of the plates 16 defines a pivot edge 32. A U-bolt 70 is inserted into the openings 20 defined proximate each of the pivot edges 32. In this manner, the two plates 16 of the collar 12 can pivot relative to a pivot point 34, as shown in FIG. 2. With this embodiment, the collar 12 can be easily secured around the shaft 62 by positioning one plate 16 around the shaft 62, as shown in FIG. 3, and securing the second plate 16 thereto such that the two plates 16 surround the shaft 60. Another U-bolt 70 is inserted into the aligned openings 20 opposite the pivot point 34, as shown in FIG. 4, to securely mount the collar 12 on the shaft 62. FIG. 5 illustrates a cross-sectional view of the collar 12 positioned around the shaft 62 in this manner. The bushing material 22 is frictionally positioned against the shaft 62 to maintain the collar 12 at the desired location. It will be noted that alternate means for securing the arcuate plates of the collar together are suitable.

The collar 12 defines a plurality of slots 36, each of which is configured to receive the first end 42 of a support arm 40. The slots 36 are equally spaced around the collar 12, as shown in FIGS. 2 and 4. It is preferable that the collar 12 includes four slots 36.

Each of the support arms 40 defines a first end 42 and a second end 46. The first end 42, as discussed above, is configured to be securely received within a slot 36 of the collar 12. The second end 46 of each of the support arms 40 carries an illuminating unit 50. The illuminating unit 50 is powered in a typical manner. Specifically, electrical lead wires 54 extend from the electrical box of the illuminating unit 50 to the main body of the ceiling fan 60, as shown in FIG. 4. Preferably, the lead wires 54 are received within the respective support arm 40 and extend back to the ceiling fan 60. The lead wires 54 are inserted into the shaft 62 of the ceiling fan 60 and run up the interior of the shaft 62. Subsequently, the lead wires 54 are electrically wired to the electrical box within the ceiling (not shown). It will be noted that the illuminating unit 50 can be an incandescent, fluorescent or halogen bulb. Further, it will be noted that if a halogen bulb is utilized, a fixture configured to withstand the heat of the bulb must be utilized.

FIG. 1 illustrates three alternate embodiments for the support arms 40 which extend in a substantially radial manner away from the collar 12. In a first embodiment, the support arms 40 are configured to extend upward above the collar 12. In the second embodiment, the support arms 40 are configured to extend downward below the collar 12. In the third embodiment, the support arms 40 are configured to extend away from the collar 12 such that the support arms 40 are substantially level with the collar 12. The embodiment chosen will determine the height relative to the fan blades 66 at which the illuminating unit 50 will be supported.

In an alternate embodiment, shown in FIG. 6, the first end 42 of each of the support arms 40 is secured to a universal mounting 28. The lead wires 54 for each illuminating unit 50 extend through its respective support arm 40 into the universal mounting 28. The lead wires 54 are electrically connectable to an appropriate pre-wired ceiling fan. Further, the universal mounting 28 is mechanically connectable to the ceiling fan. In this embodiment, it may be desirable to include a means for folding the support arms at a location proximate the universal mounting such that the device can be packaged more compactly. Specifically, the first end of each support arm can be crimped or otherwise flexible such that the arms can be folded up or down.

In the preferred embodiment, each of the support arms 40 defines a length adjustor 48 such that the distance the support arms 40 extend from the ceiling fan is adjustable. Preferably, the length of each of the support arms 40 is adjustable in a telescoping manner, as illustrated in FIGS. 1 and 6. In the preferred embodiment, each of the support arms is extendable to a position beyond the blades of the ceiling. When the light assembly is positioned above the blades, the illuminating units 50 can be extended to a position such that the rotation of the blades does not effect the light pattern. It will be noted that the telescoping support arms 40 can be controlled manually or remotely.

Further, in the preferred embodiment, the second end 46 of each of the support arms 40 is pivotable such that direction in which the respective illuminating unit 50 points is controllable. The second end 46 is carried by the support arm 40 in any suitable manner which permits at least rotation of the second end 46. In the preferred embodiment, a ball joint 44 is utilized which permits free movement of the second end 46 of each support arm 40, as shown in the Figures. It will be noted that the rotation of the second end 46 should be limited such that the lead wires 54 do not become wrapped around the support arm 40. In an alternate embodiment (not shown), each support arm can be pivotable at the first end of the support arm in the same manner as disclosed for the second end.

From the foregoing description, it will be recognized by those skilled in the art that a light assembly for securing to a ceiling fan offering advantages over the prior art has been provided. Specifically, the light assembly provides sufficient illumination to a room and illuminates a large portion of a room. The light assembly includes a plurality of support arms which extend from a securing device which is mountable to an existing ceiling fan. The support arms are telescoping such that the distance the second end, upon which illuminating units are mounted, extends from the ceiling fan is adjustable. Moreover, the second end of each support arm is pivotable such that the direction in which the illuminating unit points is controllable.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A light assembly for securing to an existing ceiling fan, said light assembly comprising:

a securing device mounting to the existing ceiling fan;

a plurality of support arms each defining a first end, a second end and a length adjustor, each of said first ends being secured to said securing device, each of said second ends carrying an illuminating unit, said length adjustor of each of said plurality of support arms being telescopic such that the distance said second end of each of said plurality of support arms extends from said securing device is adjustable.

2. The light assembly of claim 1 wherein said second end of each of said plurality of support arms is pivotable via a ball joint.

3. The light assembly of claim 1 wherein said securing device is a collar defining an interior surface and a plurality of slots, said interior surface being configured to receive a shaft of the ceiling fan, said interior surface carrying a compressible bushing material for frictionally contacting the shaft, each of said plurality of slots being configured to receive said first end of each of said plurality of support arms.

4. The light assembly of claim 1 wherein said securing device is a universal mounting to which said first end of each of said plurality of support arms is secured, each of said illuminating units including a lead wire electrically connected thereto and extending along its respective support arm into said universal mounting, each of said lead wires being electrically connected to the ceiling fan, said universal mounting being mechanically mounted to the ceiling fan.

5. A light assembly for securing to an existing ceiling fan, said light assembly comprising:

a securing device mounting to the existing ceiling fan;

a plurality of support arms each defining a first end and a second end, each of said first ends being secured to said securing device, each of said second ends carrying an illuminating unit, said second end of each of said plurality of support arms being pivotable such that said illuminating unit is directable each of said plurality of support arms being telescopic such that a distance said second end extends from said securing device is adjustable.

6. The light assembly of claim 5 wherein said second end of each of said plurality of support arms is pivotable via a ball joint.

7. The light assembly of claim 5 wherein said securing device is a collar defining an interior surface and a plurality of slots, said interior surface being configured to receive a shaft of the ceiling fan, said interior surface carrying a compressible bushing material for frictionally contacting the shaft, each of said plurality of slots being configured to receive said first end of each of said plurality of support arms.

8. The light assembly of claim 5 wherein said securing device is a universal mounting to which said first end of each of said plurality of support arms is secured, each of said illuminating units including a lead wire electrically connected thereto and extending along its respective support arm into said universal mounting, each of said lead wires being electrically connected to the ceiling fan, said universal mounting being mechanically mounted to the ceiling fan.

* * * * *